US006421874B1

(12) United States Patent
McCormick

(10) Patent No.: US 6,421,874 B1
(45) Date of Patent: Jul. 23, 2002

(54) PIVOTAL EDGE CLEANING BRUSHES FOR VACUUM CLEANER

(75) Inventor: Michael J. McCormick, Danville, KY (US)

(73) Assignee: Matsushita Electric Corporation of America, Secausus, NJ (US)

( * ) Notice: Subject to any disclaimer, the term of this patent is extended or adjusted under 35 U.S.C. 154(b) by 0 days.

(21) Appl. No.: 09/573,593

(22) Filed: May 18, 2000

Related U.S. Application Data

(60) Provisional application No. 60/144,554, filed on Jul. 16, 1999.

(51) Int. Cl.[7] ..... A47L 9/04; A47L 9/06
(52) U.S. Cl. ..... 15/364; 15/365; 15/373
(58) Field of Search ..... 15/365, 373, 364

(56) References Cited

U.S. PATENT DOCUMENTS

| | | | | |
|---|---|---|---|---|
| 1,094,579 A | | 4/1914 | Matchette | |
| 1,940,954 A | * | 12/1933 | Kohler | 15/364 |
| 2,047,677 A | * | 7/1936 | Edstrom | 15/365 X |
| 2,078,101 A | | 4/1937 | Schmermund | |
| 2,241,776 A | | 5/1941 | Dahl | |
| 2,348,861 A | | 5/1944 | Smellie | |
| 3,382,525 A | * | 5/1968 | Belicka | 15/365 |
| 3,533,120 A | | 10/1970 | De Mercado | |
| 3,715,772 A | | 2/1973 | Downing et al. | |
| 3,729,769 A | | 5/1973 | Sharpless | |
| 4,109,342 A | | 8/1978 | Vermillion | |
| 4,198,727 A | | 4/1980 | Farmer | |
| 4,219,902 A | | 9/1980 | DeMaagd | |
| 4,685,170 A | | 8/1987 | Ahlf et al. | |
| 5,475,893 A | | 12/1995 | Sepke | |
| 6,094,776 A | * | 8/2000 | Fish | 15/364 X |

FOREIGN PATENT DOCUMENTS

| | | | | |
|---|---|---|---|---|
| GB | 1426686 | * | 3/1976 | 15/364 |

* cited by examiner

*Primary Examiner*—Chris K. Moore
(74) *Attorney, Agent, or Firm*—King and Schickli, PLLC

(57) ABSTRACT

A vacuum cleaner includes a housing having a handle pivotally mounted to a nozzle assembly. An agitator is received in an agitator cavity formed in the nozzle assembly. A suction fan and suction fan drive motor are carried on the housing. An edge cleaning brush is pivotally mounted to the nozzle assembly along a lateral edge of the nozzle assembly adjacent the agitator cavity. The brush includes a body having a series of apertures for receiving cleaning bristles and a pair of opposed mounting lugs. The edge cleaning brush is received in a recess with the mounting lugs held in a pair of opposed mounting openings in the nozzle assembly.

20 Claims, 3 Drawing Sheets

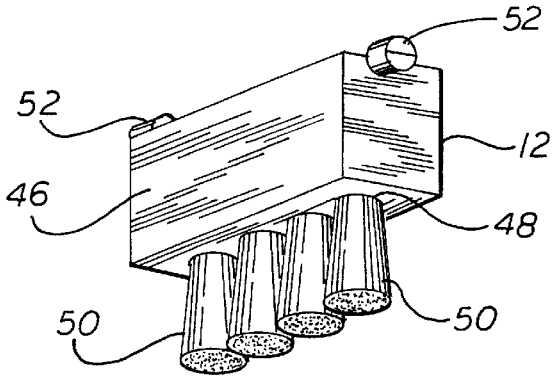
Fig. 2
Fig. 4
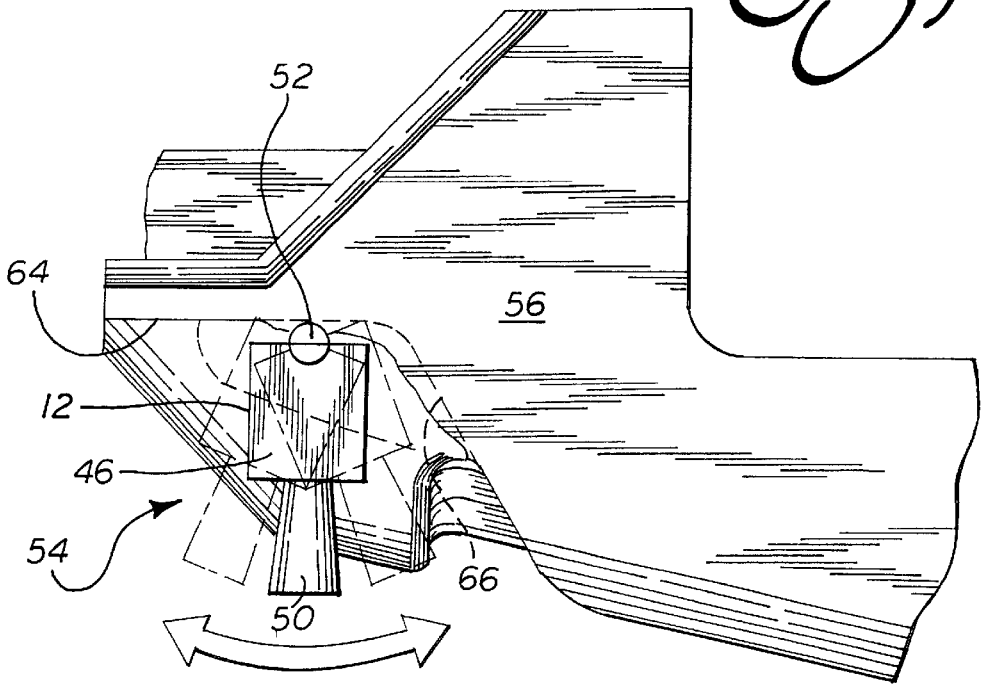

PIVOTAL EDGE CLEANING BRUSHES FOR VACUUM CLEANER

This application claims priority from provisional application Ser. No. 60/144,554, filed Jul. 16, 1999.

TECHNICAL FIELD

The present invention relates generally to the vacuum cleaner art and, more particularly, to edge cleaning brushes for a vacuum cleaner.

BACKGROUND OF THE INVENTION

A vacuum cleaner is an electromechanical appliance utilized to effect the dry removal of dust, dirt and other small debris from carpets, rugs, fabrics or other surfaces in both domestic and industrial environments. In order to achieve the desired dirt and dust removal, a rotary agitator is provided to beat dirt and dust from the nap of the carpet and a pressure drop or vacuum is used to force air entrained with this dirt and dust into the nozzle of the vacuum cleaner. The particulate-laden air is then drawn through a bag-like filter or a cyclonic separation chamber and filter combination which traps the dirt and dust, while the substantially clean air is exhausted by an electrically operated fan that is driven by an on board motor. It is this fan and motor arrangement that generates the drop in air pressure necessary to provide the desired cleaning action. Thus, the fan and motor arrangement is commonly known as the vacuum or suction generator.

Generally, the rotary agitator of a vacuum cleaner is supported at each end in a bearing block. As a result, the rotary agitator provides brushing action all the way across the vacuum cleaner between the two bearing blocks at the outer side margins thereof. While generally functional, this arrangement has one serious drawback. When cleaning, for example, along a baseboard, the lack of brushing capability at the side margin of the vacuum cleaner (i.e. underneath the bearing block on that side) means that the floor cleaning action of the vacuum cleaner adjacent the baseboard is strictly limited to the movement of air being drawn into the nozzle. This air pressure is not sufficiently strong in many instances to lift dirt such as dog hair from the floor. Accordingly, cleaning action suffers.

Recognizing this shortcoming, attempts have been made in the past to enhance the cleaning of a vacuum cleaner at its side margins. In, for example, U.S. Pat. No. 1,094,579 to Matchette and U.S. Pat. No. 4,219,902 to DeMaagd, stationary brushes are mounted at an angle in the side of the nozzle assembly and project outwardly beyond the peripheral side margins thereof to clean the corner of the floor where the floor meets the baseboard. Such brush arrangements do not represent a particularly effective solution to the problem. This is because there is a gap between the bristles of the rotary agitator and the stationary brushes. As such a strip of the floor adjacent the baseboard remains unbrushed.

An alternative prior art approach is disclosed in U.S. Pat. No. 5,475,893 to Sepke. This patent teaches a height adjustable edge brush having a longitudinal axis of bristles which extend along the peripheral side margin of the vacuum cleaner. Once again a significant gap exists between the edge brushes and the bristles of the rotary agitator. Further, brushes of this type significantly increase the friction of the vacuum cleaner with the floor and, accordingly, the effort necessary to move the vacuum cleaner to-and-fro during cleaning. This is an undesirable side effect since it makes the vacuum cleaner more difficult to use effectively.

SUMMARY OF THE INVENTION

In accordance with the purposes of the present invention as described herein, an improved vacuum cleaner is provided. The vacuum cleaner includes a housing having a nozzle assembly. A suction fan and suction fan drive motor are carried on the housing.

These components operate together to produce the negative pressure or suction that draws dust and dirt laden air into the vacuum cleaner. The vacuum cleaner also includes an edge cleaning brush pivotally mounted to an outer peripheral margin of the nozzle assembly.

The edge cleaning brush preferably includes a body having a series of apertures for receiving cleaning bristles and a pair of opposed mounting lugs. The nozzle assembly includes a recess and a pair of opposed openings for receiving those mounting lugs.

More specifically describing the invention, the vacuum cleaner may include a housing having a nozzle assembly and agitator cavity. A suction fan and suction drive motor are carried in this housing and a driven rotary agitator is received in the agitator cavity. An edge cleaning brush is pivotally mounted to the nozzle assembly along a lateral edge of the nozzle assembly adjacent the agitator cavity. The edge cleaning brush includes a body having a series of apertures for receiving cleaning bristles and a pair of opposed mounting lugs. The nozzle assembly includes a recess and a pair of opposed openings for receiving the mounting lugs. When properly mounted in the recess, the edge cleaning brush is capable of pivoting through an arc of between, for example, 20° to 80°. Thus, the brush pivots rearwardly as the vacuum cleaner is pushed forward by the operator and the brush pivots forwardly as the vacuum cleaner is pulled backward by the operator. As a result of the pivoting motion of the edge cleaning brush, the underlying carpet at the edge of the nozzle assembly is brushed to remove dirt and debris but additional frictional resistance to movement from engagement of the edge cleaning brush with the floor is minimized. Accordingly, very little if any discernible additional effort is required to manipulate the vacuum cleaner.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings:

FIG. 2 is a detailed perspective view of an edge cleaning brush constructed in accordance with the teachings of the present invention;

FIG. 4 is a detailed side elevational view illustrating the pivoting movement of the edge cleaning brush.

Reference will now be made in detail to the present preferred embodiment of the invention, an example of which is illustrated in the accompanying drawings.

DETAILED DESCRIPTION OF THE INVENTION

Figure 1:
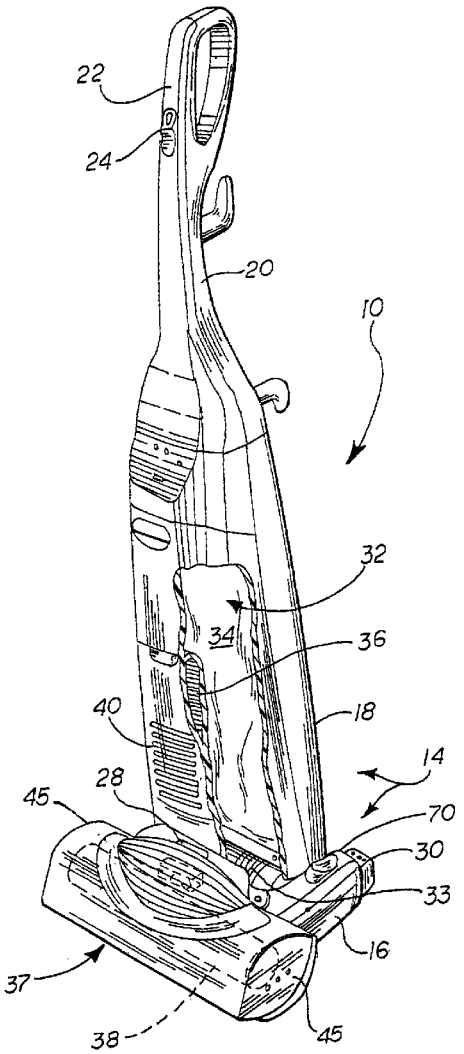
FIG. 1 is a perspective view of the vacuum cleaner of the present invention.
Figure 3:
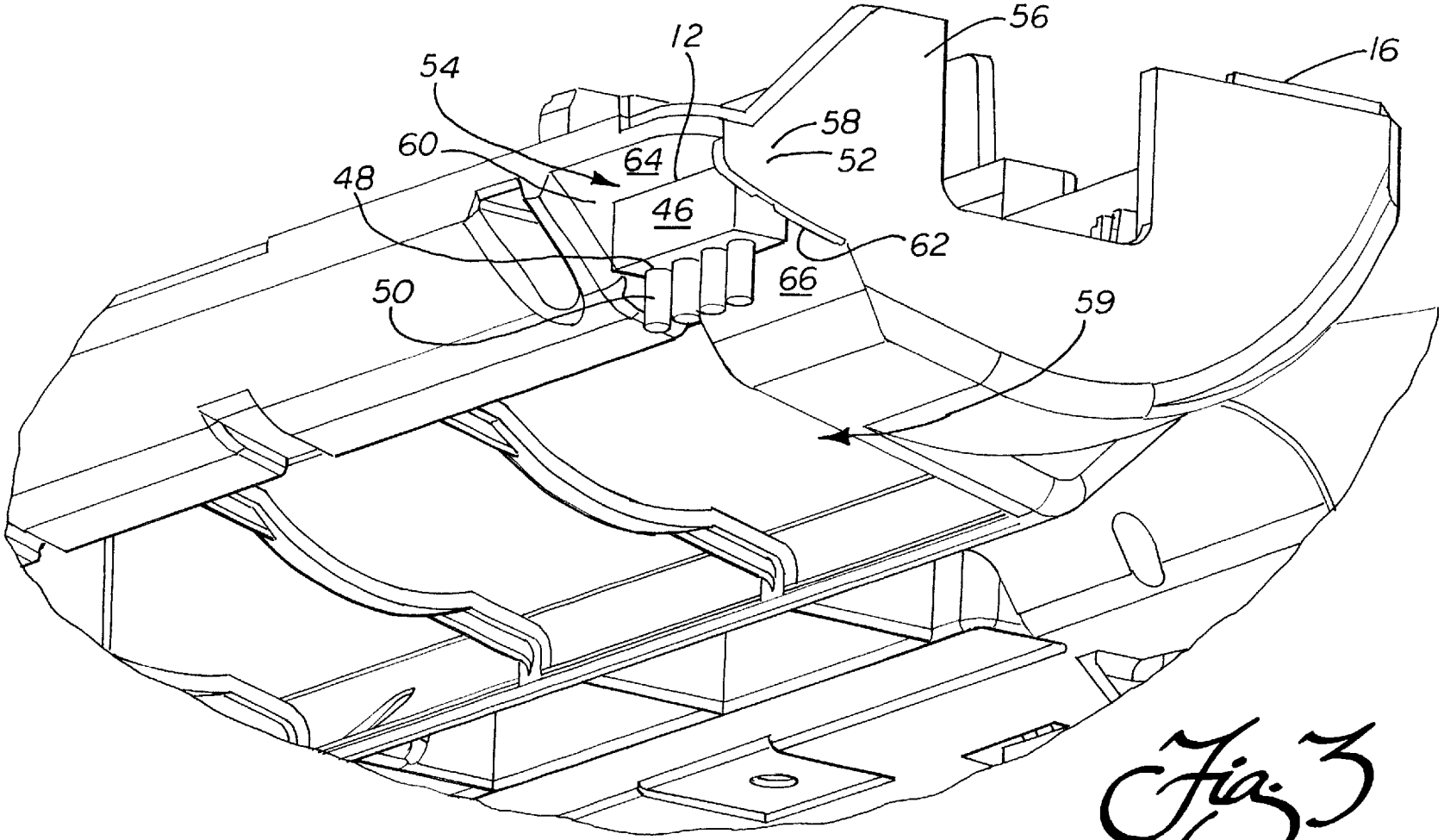
FIG. 3 is a perspective bottom plane view showing the edge cleaning brush mounted for pivotal movement in the lower plate of the nozzle assembly.

Reference is now made to FIGS. 1–3 showing the vacuum cleaner 10 of the present invention. The overall basic design of the upright vacuum cleaner 10 is generally well known in the art. In the typical arrangement, the upright vacuum cleaner 10 includes a housing 14 that comprises the nozzle assembly 16 and the canister assembly 18. The canister assembly 18 further includes the handle 20 and the hand grip 22. The hand grip 22 carries a control switch 24 for turning the vacuum cleaner 10 on and off. Of course, electrical power is supplied to the vacuum cleaner 10 from a standard electrical wall outlet through a cord (not shown).

At the lower portion of the canister assembly 18, rear wheels (not visible in FIG. 1) are provided to support the weight of the vacuum cleaner 10. A second set of wheels (also not shown) allow the operator to raise and lower the nozzle assembly 16 through selective manipulation of the height adjustment switch 28 by means of a height adjustment mechanism of a type well known in the art. To allow for convenient storage of the vacuum cleaner 10, a foot latch 30 functions to lock the canister assembly 18 in an upright position, as shown in FIG. 1. When the foot latch 30 is released, the canister assembly 18 may be pivoted relative to the nozzle assembly 16 as the vacuum cleaner 10 is manipulated to clean the floor.

The canister assembly 18 also carries an internal chamber 32 that houses a suction generator 33 (i.e. a state of the art fan and motor combination) and a dust bag 34 for removing dirt or dust entrained in the air stream as it passes from the nozzle assembly 16 to the suction generator. The canister assembly may also carry a final filtration cartridge 36 to trap small particulates and prevent their reintroduction into the environment through the exhaust air stream.

The nozzle assembly 16 includes a nozzle and agitator cavity 37 that houses a rotating agitator brush 38. The agitator brush 38 shown may either be rotatably driven by a motor and cooperating gear drive (not shown) housed within the agitator or a motor and belt drive carried on the nozzle assembly 16 in a manner very well known in the art. In the illustrated vacuum cleaner 10, the scrubbing action of the rotary agitator brush 38 and the negative air pressure created by the suction generator 33 cooperate to brush and beat dirt and dust from the nap of the carpet being cleaned and then draw the dirt and dust laden air from the agitator cavity 37 to the dust bag 34. Specifically, the dirt and dust laden air passes serially through a suction inlet and hose (not visible in FIG. 1) and/or an integrally molded conduit in the nozzle assembly 16 and/or canister assembly 18 as is known in the art. Next, it is delivered into the dust bag 34 and passes through the porous walls thereof into the chamber 32. The bag 34 serves to trap the suspended dirt, dust and other particles inside while allowing the now clean air to pass freely through the wall thereof and then through the chamber 32 to the suction generator 33, final filtration cartridge 36 and ultimately to the environment through the exhaust port 40.

Preferably, an edge cleaning brush 12 is provided at the left and right marginal edges of the nozzle assembly 16 at the front of each projecting side stalk 45 that forms the overall "hammerhead" shape of the nozzle assembly 16. The side stalks 45 also include a low profile to allow clearance, for example, under cabinets so that the vacuum cleaner 10 may be used to clean along the toe plate of a kitchen or bathroom cabinet. Advantageously, with projecting low-profile side stalks 45 at each side, the vacuum cleaner 10 may be used to clean under such overhangs in either direction: that is, the vacuum cleaner is not limited to either right hand or left hand operation.

One edge cleaning brush 12 is shown in detail in FIG. 2. Each edge cleaning brush 12 includes a body 46 formed of plastic such as ABS, PVC, nylon or other appropriate material known in the art. The body 46 includes a series of apertures 48. Each aperture 48 receives and holds a tuft of bristles 50. Further, a pair of opposed mounting lugs 52 project outwardly from the sides of the body 46.

As best shown in FIGS. 3 and 4, the edge cleaning brush 12 is received in a recess 54 formed in the lower plate 56 of the nozzle assembly 16. A pair of opposed mounting apertures 58 are provided in opposite side walls 60, 62 of the recess 54. The edge cleaning brush 12 is mounted in the recess 54 by snapping the opposed mounting lugs 52 into the opposed mounting apertures 58. The mounting lugs 52 and mounting apertures 58 are sized so as to provide the necessary clearance to allow free pivoting movement of the edge cleaning brush 12 in the recess 54 relative to the nozzle assembly 16.

Figure 5:
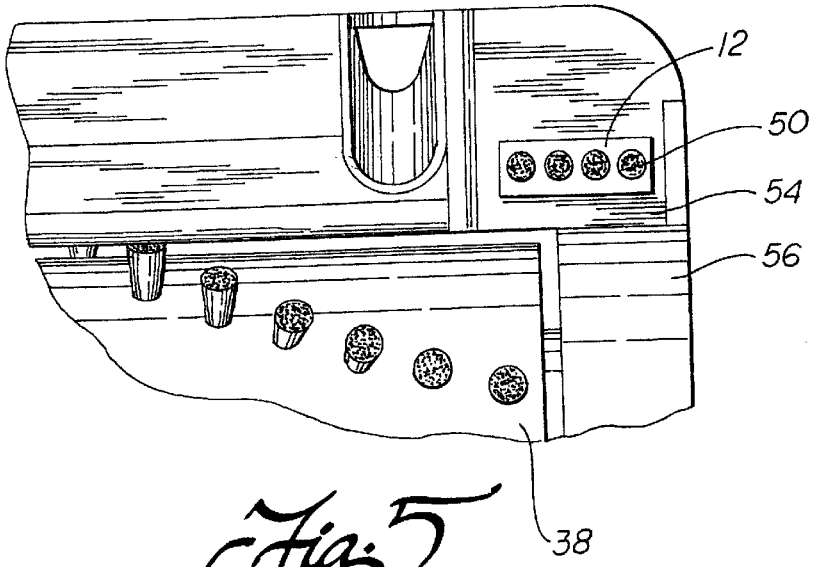
FIG. 5 is a schematical bottom plan illustration showing how the edge cleaning brush at one side of the vacuum cleaner extends inwardly from the outer sidewall of the nozzle assembly so as to transversely overlap the agitator and insure full cleaning action across the entire width of the vacuum cleaner.

As should be appreciated, the longitudinal axis of the tufts of bristles 50 in the edge cleaning brush 12 is aligned with the pivotal axis of the brush 12 and both extend perpendicular to the side edge of the nozzle assembly 16. Further, the recess 54 and, accordingly, the brush 12 extend from the side edge fully across to the agitator cavity opening 59 and the bristles of the rotary agitator 38. In fact, since the recess 54 for mounting the edge cleaning brush 12 is positioned forward of the rotary agitator 38, an overlap can be provided if desired (see FIG. 5). Accordingly, the gap between the edge cleaning brush 12 and the rotary agitator 38 may be minimized or entirely eliminated as desired to provide full carpet cleaning action across the entire width of the nozzle assembly 16.

Preferably, the edge cleaning brush 12 pivots in the recess 54 with respect to the nozzle assembly 16 through an arc of between substantially 20°–80° (note particularly FIG. 4). Thus, as the vacuum cleaner 10 is moved in a forward direction, the edge cleaning brush 12 pivots rearwardly and as the vacuum cleaner is moved in a rearward direction, the edge cleaning brush pivots forwardly. The pivoting action of the edge cleaning brush 12 is limited by engagement of the body 46 thereof with the upper and/or rearward walls 64, 66 of the recess 54. This insures that the tufts of bristles 50 of the edge cleaning brush 12 remain in contact with the underlying carpet to sweep dirt and dust from the nap thereof while sufficient pivoting action is allowed to reduce the frictional engagement with the carpet. As a result, there is no apparent additional effort necessary to manipulate the vacuum cleaner to-and-fro as a result of the engagement of the edge cleaning brush 12 with the underlying floor.

Of course, while only one edge cleaning brush 12 has been shown and described in detail, it should be appreciated that an additional edge cleaning brush 12 may be mounted at the opposite side of the nozzle assembly 16 in exactly the same manner to function in exactly the same way just described. It should be appreciated, however, that the edge cleaning brushes 12 at each side of the nozzle assembly do not need to be of the same dimension and may be altered in length or any other dimension, as required to match the width of the nozzle assembly outside the bristles of the rotary agitator brush.

The foregoing description of the preferred embodiment of the invention has been presented for purposes of illustration and description. It is not intended to be exhaustive or to limit the invention to the precise form disclosed. Obvious modifications or variations are possible in light of the above teachings. For example, it should be appreciated that while an upright vacuum cleaner 10 is illustrated, canister vacuum cleaners incorporating a driven rotary agitator in what is referred to in the art as a "power nozzle" may also utilize and benefit from the novel edge cleaning brush 12.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A vacuum cleaner, comprising:

a housing including a nozzle assembly;

a suction fan and suction fan drive motor carried on said housing; and an edge cleaning brush mounted to an outer peripheral margin of said nozzle assembly so as to allow pivotal movement of said edge cleaning brush in a fore-and-aft direction relative to said nozzle assembly.

2. A vacuum cleaner, comprising;

a housing including a nozzle assembly and agitator cavity;

a suction fan and suction fan drive motor carried on said housing;

a driven rotary agitator received in said agitator cavity; and an edge cleaning brush pivotally mounted to said nozzle assembly along a lateral edge of said nozzle assembly adjacent said agitator cavity so as to allow pivotal movement of said edge cleaning brush in a fore-and-aft direction relative to said nozzle assembly.

3. A vacuum cleaner, comprising:

a housing including a handle pivotally connected to a nozzle assembly;

an agitator cavity in said nozzle assembly;

an agitator received in said agitator cavity and mounted for rotation relative to said nozzle assembly;

a suction fan and suction fan drive motor carried on said housing; and an edge cleaning brush pivotally mounted to said nozzle assembly along a lateral edge of said nozzle assembly adjacent said agitator cavity.

4. The vacuum cleaner of claim 3, wherein said edge cleaning brush includes a body having a series of apertures for receiving cleaning bristles and a pair of opposed mounting lugs.

5. The vacuum cleaner of claim 4, wherein said nozzle assembly includes a recess defined between a pair of opposing sidewalls and a pair of opposed openings for receiving said mounting lugs, one of said opposed openings being provided in each of said pair of sidewalls.

6. The vacuum cleaner of claim 5, wherein said recess includes a pair of walls limiting pivotal movement of said edge cleaning brush through an arc of between 20°–80°.

7. The vacuum cleaner of claim 6, wherein said recess extends across said nozzle assembly between a side edge thereof to an agitator cavity opening in said nozzle assembly.

8. The vacuum cleaner of claim 7, wherein said recess is positioned on said nozzle assembly in front of said agitator cavity opening.

9. The vacuum cleaner of claim 3, wherein said nozzle assembly is hammerhead shaped.

10. The vacuum cleaner of claim 3, wherein said edge cleaning brush extends transversely across said nozzle assembly from a peripheral side edge thereof inwardly so as to overlap said agitator.

11. A vacuum cleaner, comprising:

a housing including a nozzle assembly;

a suction fan and suction fan drive motor carried on said housing; and an edge cleaning brush pivotally mounted to an outer peripheral margin of said nozzle assembly, said edge cleaning brush including a body having a series of apertures for receiving cleaning bristles and a pair of opposed mounting lugs.

12. The vacuum cleaner of claim 11, wherein said nozzle assembly includes a recess defined between a pair of opposing sidewalls and a pair of opposed openings for receiving said mounting lugs, one of said pair of opposed openings being provided in each of said pair of sidewalls.

13. The vacuum cleaner of claim 12, wherein said recess includes a pair of walls limiting pivotal movement of said edge cleaning brush through an arc of between 20°–80°.

14. The vacuum cleaner of claim 13, wherein said recess extends across said nozzle assembly between a side edge thereof to an agitator cavity opening in said nozzle assembly.

15. The vacuum cleaner of claim 14, wherein said recess is positioned on said nozzle assembly in front of said agitator cavity opening.

16. A vacuum cleaner, comprising;

a housing including a nozzle assembly and agitator cavity;

a suction fan and suction fan drive motor carried on said housing;

a driven rotary agitator received in said agitator cavity; and an edge cleaning brush pivotally mounted to said nozzle assembly along a lateral edge of said nozzle assembly adjacent said agitator cavity, said edge cleaning brush including a body having a series of apertures for receiving cleaning bristles and a pair of opposed mounting lugs.

17. The vacuum cleaner of claim 16, wherein said nozzle assembly includes a recess defined between a pair of opposing sidewalls and a pair of opposed openings for receiving said mounting lugs, one of said pair of opposed openings being provided in each of said sidewalls.

18. The vacuum cleaner of claim 17, wherein said recess includes a pair of walls limiting pivotal movement of said edge cleaning brush through an arc of between 20°–80°.

19. The vacuum cleaner of claim 18, wherein said recess extends across said nozzle assembly between a side edge thereof to an agitator cavity opening in said nozzle assembly.

20. The vacuum cleaner of claim 19, wherein said recess is positioned on said nozzle assembly in front of said agitator cavity opening.

* * * * *